United States Patent [19]

Ciccone et al.

[11] Patent Number: 4,765,239

[45] Date of Patent: Aug. 23, 1988

[54] MULTI-IMPRESSION SYSTEMS WITH INDEXING OF PRINTING CYLINDER

[76] Inventors: Nicolas T. Ciccone; Hector H. Ciccone, both of Irigoyen 417/19, 1407 Capital Federal, Argentina

[21] Appl. No.: 873,161

[22] Filed: Jun. 17, 1986

[30] Foreign Application Priority Data

May 28, 1986 [AR] Argentina ..... 304149

[51] Int. Cl.[4] ..... B41F 7/04; B41F 21/08

[52] U.S. Cl. ..... 101/91; 101/142

[58] Field of Search ..... 101/217, 228, 216, 177, 101/183, 92, 91, 181, 137, 232, 136, 137, 138, 139, 141-143, 144, 248

[56] References Cited

U.S. PATENT DOCUMENTS

| | | | |
|---|---|---|---|
| 1,935,799 | 11/1933 | Jamison | 101/92 |
| 2,164,852 | 7/1939 | Zimmerman | 101/91 |
| 2,220,903 | 11/1940 | Higgins et al. | 101/92 |
| 2,245,343 | 6/1941 | Hunting | 101/83 X |
| 2,297,846 | 10/1942 | Van Benschoten | 101/177 X |

*Primary Examiner*—J. Reed Fisher

*Attorney, Agent, or Firm*—McGlew and Tuttle

[57] ABSTRACT

A machine and process for printing sets of documents each having common repetitive impressions such as security backgrounds and general information identifying a banking entity, semi-repetitive impressions such as personalized account and bank branch information, and wherein each document in the set has its own differentiated impressions such as the number of the check and a magnetic reading strip containing machine readable information, comprising a reporter-impression matrix plate which carries the semi-repetitive impressions and which is mounted on a printing cylinder, printing the documents with the semi-repetitive impressions using the reporter-impression matrix plate, providing a further reporter-impression matrix plate which has a printing length divided by the number of differentiated impressions that are needed to print the set of documents, and printing each document with its own differentiated impression which is taken from the further matrix plate. The further matrix plate is mounted on a cylinder which is indexed by the angular amount necessary to bring a new differentiated impression into registry with a print transferring mechanism, each time a new document from the set is to be printed. In this way each document in the set is printed with the same semi-repetitive impression from the first matrix plate, and then printed with its own differentiated impression from the further matrix plate.

4 Claims, 3 Drawing Sheets

MULTI-IMPRESSION SYSTEMS WITH INDEXING OF PRINTING CYLINDER

FIELD AND BACKGROUND OF THE INVENTION

The present invention refers broadly to high-quality multi-impression systems and more particularly to a procedure for the repetitive printing of checks and other documents in runs responding to different contents and pressruns and to the machine used in said procedure.

In present printing techniques, the printing of documents does not entail inconveniences even when a given document may appear to have a difficult composition. The document can be printed either in typography, gravure, planography, lithography, phototype or offset in accordance with requirements such as quality, speed, press-runs, monoor polychromatic printing.

Four color process printing is usually carried out by means of a continuous train of impression rollers fed by different fountains through inking rollers, in order to print several tones in only one run, although not simultaneously.

The condition is this type of printer is that the number of data, texts or other printable elements must respond to a like number of repetitive compositions to allow same to be produced simultaneously.

However, some printings require a composition having texts or fields submitted to different pressruns, ranging from a high-run printing to a printing destined for an individual or small number of documents. For instance checks, deposit or withdrawal tickets, nominal shares, etc fall into this category.

In the above type of documents, the printings corresponding to each run can be identified and grouped in three types constituting three basic sets, i.e.:

a. Sets of documents having impressions which are repetitive and common to all, such as security backgrounds and those corresponding to letter-heads of companies or banks including their logotype, isotype or isologotype.
b. Sets of documents having semi-repetitive impressions common to some such as main offices or branches, payment address, individualization of account holder and account number; and
c. Sets of documents having particular impressions which are not repetitive and different, such as the number of each check, ticket or share, as well as information and magnetic reading strips.

Although, as stated hereinbefore, documents and printable material may be of any type or nature, in order to provide a clear interpretation and development of this invention reference shall be made exclusively to the printing of checks, it being understood that the latter is by way of example only, does not constitute a limitation in the scope of the invention and that the description of the characteristics in the printing of checkbooks is equally valid for any other type of documents with the corresponding adaptation of diagrams and composition.

With reference to the above described three types of printings as regards checks, it can be appreciated that each banking entity must print large amounts of checks bearing its identification and security background common to all checks printed for the same bank (for instance a pressrun of 1,000,000 basic printings for a set described in c. above).

However, it is not possible to incorporate in said basic printing other data, such as that described in point b above, because for instance the payment varies for each branch, as well as the code number identifying the latter and establishing the type of clearance it employs. Consequently, the original pressrun must be subdivided by branches, the data and clearing of which is to be printed simultaneously with the printing of the account holder's name and account number in response to the requests of each branch. For instance, if account holder "NN" has requested two checkbooks with 50 checks each, 100 personalized checks must be printed together with the data of the branch (payment address, code numbers, etc.) (set b.).

However, it is not possible to print in said pressrun the check number and the magnetic reading strip because said data vary with each individual check and this printing is not repetitive (set c.).

Accordingly, in what concerns the personalization of documents for set b. and set c., it is not possible to utilize the traditional high-quality printing procedures such as offset, because there is a requirement for a correlative numerical sequence printing to be repeated on the stub of each check. In turn, the magnetic strip requires a sequential printing with magnetic ink having a standardized content (numerical data corresponding to the bank and/or branch, account number and check number) and also a standardized design and printing manner in order to permit a direct visual reading as well as an electronic reading by conventional electronic systems (CMC7 or E13B, for instance).

Consequently, in order to carry out limited run printings, there is a need to utilize low-quality procedures such as impactprinting and typing transference inking tapes, which limits the impression spectrum as graphics and design printing cannot be used. In addition, said low-quality procedures produce low-quality results increased by virtue of the contrast with the basic printing, and also produce typographic misalignments and are susceptible to alterations by scraping or erasing which infringes security principles governing this type of document.

The personalization of checks having differentiated and non-repetitive impressions could not be carried out with high-quality procedures, such as offset or impression transference, because the high cost of plate matrixes and the complications involved in assembling and disassembling said plates for limited or unitary impressions renders uneconomical said procedures. In addition, the considerable time involved in such operations would diminish printing capacity to a large extent.

Summary of The Invention

In particular, the present invention provides a solution to the above shortcomings permitting the printing of documents in differentiated runs in a unitary high-quality offset procedure, applicable in high and medium run stages and specially in limited runs, including the impression of a single document for each text.

Consequently, a high acceptance of this procedure is foreseeable irrespectively of the category and destination requirements due to the fact that its characteristics render it adaptable to highquality printing, such as offset, of checks, deposit and withdrawal bank tickets, nominal shares, etc.

MAIN OBJECT

The procedure of this invention is directed to resolve the problems inherent in the repetitive printing of checks and other documents in runs responding to differentiated contents and pressruns, wherein the documents constitute sets requiring common and repetitive impressions—such as security backgrounds and general identification data of a bank—common semirepetitive impressions—such as the bank branch, payment address, clearing code, account number and account holder identification—and particular differentiated impressions, such as check number and magnetic reading strip information.

Accordingly, the procedure of the present invention, being based on the repetitive impression of sheets, is characterized by comprising the following stages: producing a semi-repetitive reporter—impression matrix plate in accordance with the semi-repetitive printing pattern prearranged for one of the corresponding sets, assembling said plate on a plate-bearing roller to print therewith the total number of documents constituting said set; preparing a matrix plate dividing its useful length by the number of possible and prearranged printing variants, destined to the above set of documents; producing said reporter-impression matrix plate divided in accordance with the above mentioned particular printing pattern and assembling said plate in a plate bearing roller; causing the latter plate-bearing roller to advance step by step by angular displacements individually coinciding with an impression transference means, and printing by said transference means the document sheets with the corresponding differentiated impressions.

BRIEF DESCRIPTION OF THE DRAWINGS

In order that the invention may be clearly understood, a schematic representation thereof is illustrated in the attached drawings, it being understood that the latter represent a preferred embodiment of this invention and is not intended to limit the scope thereof. In the drawings:

FIG. 1 illustrates the path followed by the sheets to be printed from entry to outlet in the different impression stages of said procedure and with differentiated runs.

In the figures, like reference numerals represent identical or corresponding parts, and groupings of several elements are represented by letters.

Figure 1:
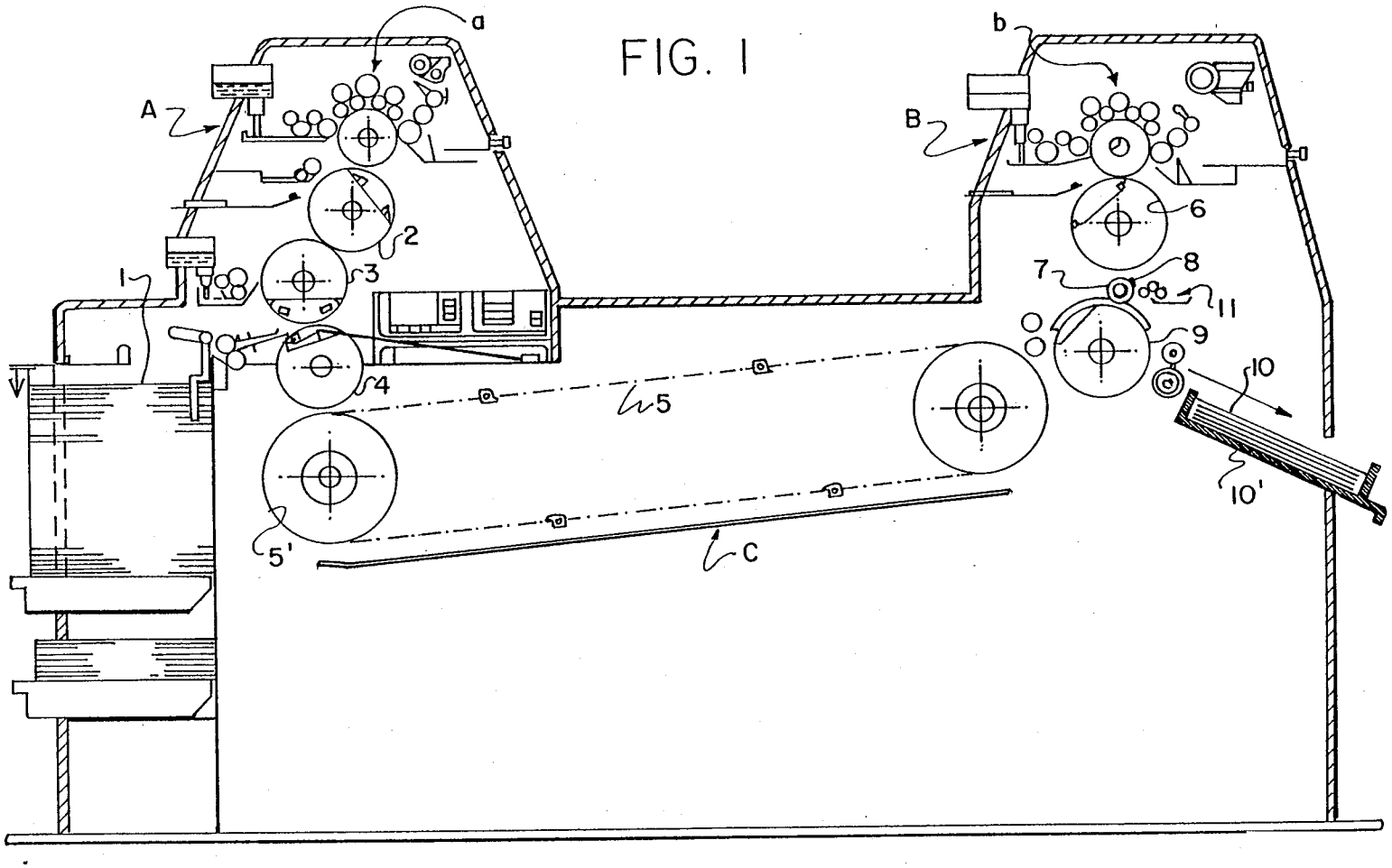
FIG. 1 is a schematic illustration of the printing machine, constituted by two of the basic printing bodies, wherein the general arrangement thereof can be appreciated.

The above references correspond to the following details:

A. First printing body, corresponding to semi-repetitive impressions 2'-A.

B. Second printing body, corresponding to particular impressions 2'-B.

C. Sheet transporter between A and B.

a. Train of inking rollers and fountain of body A.

b. Train of inking rollers and fountain of body B.

1. Sheet previously printed with common and repetitive impressions.

2. Matrix-plate bearing roller for impression of 2'-A.

2'-A. Impression of semi-repetitive content common to some documents 10 and produced in body A.

2'-B. Impression of particular content of each document 10 produced in body B.

3. Impression transference cylinder of 2., or with rubber blanket, in body A.

4. Impression or counterpressure cylinder with 3, in body A.

5. Transporter chain C.

5'. chain drive wheel.

6-B.Matrix plate-bearing roller for impression of 6'-B in body B.

6'-B.Particular content impression for each document 10 and corresponding to arabic numeration thereof (impression or division section).

6''-B.Particular content impression for each document 10 and corresponding to magnetic impression (impression or division section).

7. Impression transference cylinder of impression 2'-B or rubber bearing cylinder in body B.

8. Impression transference rubber blanket of impression in 7, body B.

9. Impression or counterpressure cylnder in 8, body B.

10. Printed sheet.

10'.Machine outlet tray with sheets 10.

11. Cleaning roller train of rubber blanket 8.

DESCRIPTION OF THE PREFERRED EMBODIMENT

Figure 4:
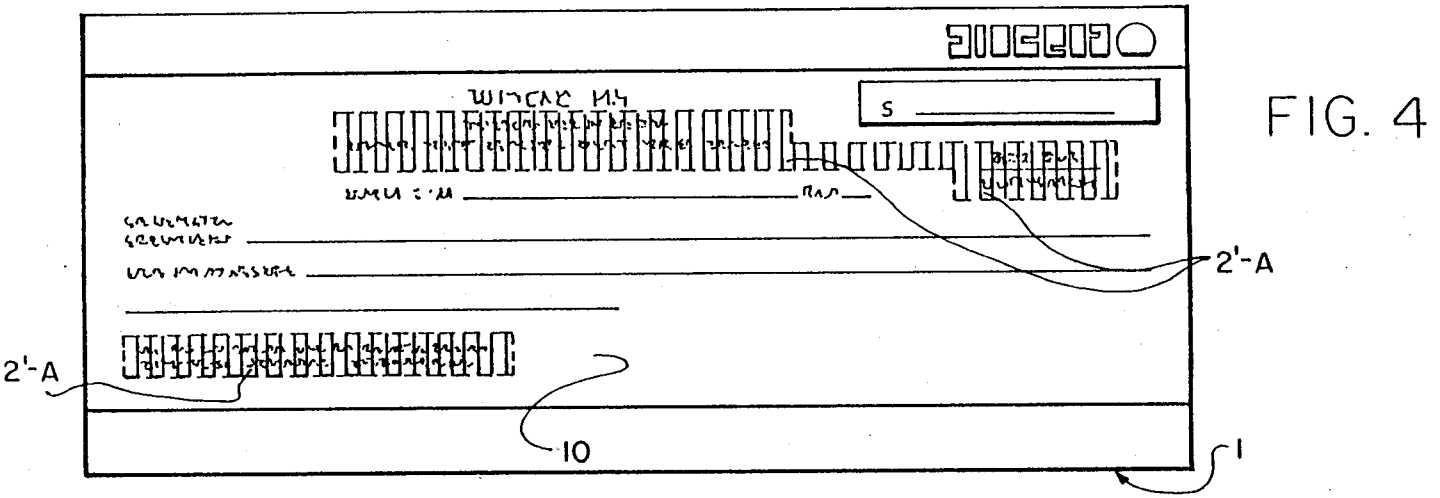
FIG. 4 is a schematic view of the printing diagram of a document, in this case a check, with abstract symbols representing the semi-repetitive impressions printed in accordance with the procedure and machine of this invention, and, FIG. 5 is another view of the diagrammed check as it arrives to the machine and illustrating its general repetitive impressions corresponding to the security background and identification data of the issuing bank, completed with the semi-repetitive impressions of FIG. 4 and with the particular impression of check number and magnetic reading strip.
Figure 5:
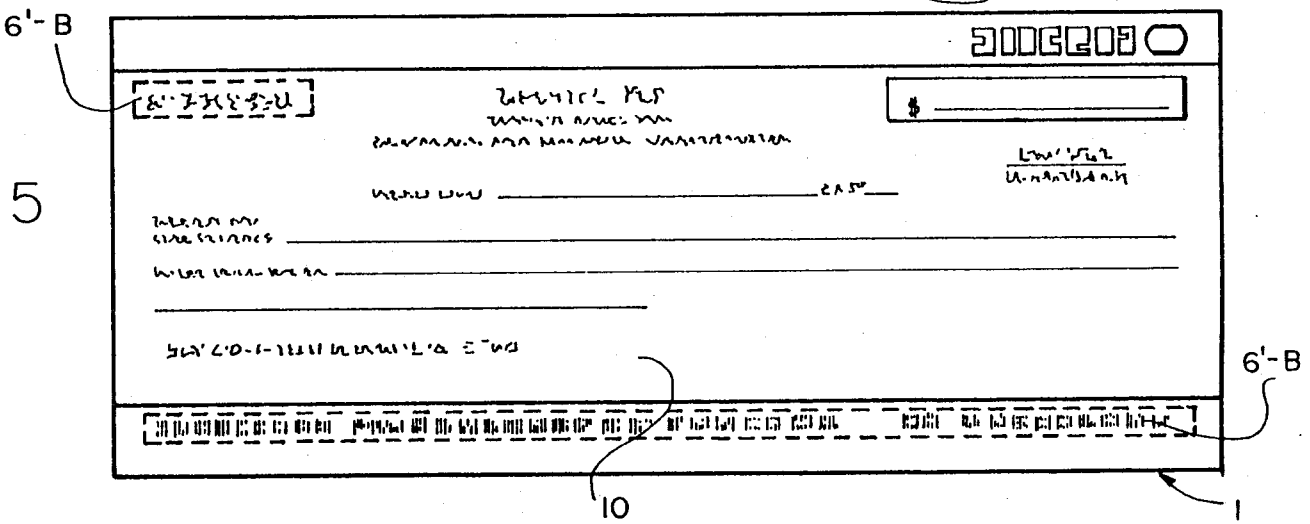

In general terms, and starting from the nonlimitative example in the sense that printed sheets 1 correspond to documents such as checks (FIGS. 4 and 5), firstly a large offset printing pressrun is produced to print the repetitive impressions common to all checks 10, i.e. the security background, vignettes, stripes, emblems, logotypes, isotypes and denomination of the banking entity to which said document 10 belongs (FIG. 5).

Secondly, the machine of FIG. 1 is loaded with the thus pre-impressed sheets 1 to carry out the semi-repetitive impressions 2'-A and particular impressions 6'B and 6''B by the offset procedure.

In particular, essentially the printing machine (FIG. 1) comprises two printing bodies A and B, of which A is destined to effect semirepetitive impressions 2'-A corresponding to the identification of the branch or main offices of the bank, payment address, code number of said bank, clearing code and personalization of the check with the account number and account holder name (FIG. 4). In turn, printing body B is destined to carry out the specific and particular impressions 6'-B and 6''-B corresponding to the magnetic reading strip with the information, diagramming and design standardized according to the type of magnetic reading system to be employed, and the number of each check, respectively.

The outlet of sheets 1 in body A is connected to the inlet in body B by means of a plier chain conveyor C, the machine having at the inlet and outlet thereof loaders to load the semi-printed sheets 1 and printed sheets 10' (FIG. 1). The machine may also include automatic insertion stations of masters or printing matrix plates 2 and 6.

In order to achieve maximum use of sheet 1, to reduce printing costs and to obtain a greater printing production, the machine is equiped for printing several checks simultaneously (for instance, four checks or documents per sheet).

The first printing body A essentially consists in a fountain and inking rollers A feeding and inking the matrix-plate bearing cylinder 2, the periphery of which engages the rubber bearing cylinder 3, destined to transfer impression 2'-A on sheet 1, printing cylinder 4 acting to provide the necessary counterpressure against cylinder 3 through sheet 1 being impressed by 2'-A (FIGS. 1, 4 and 5).

Figures 2, 3:
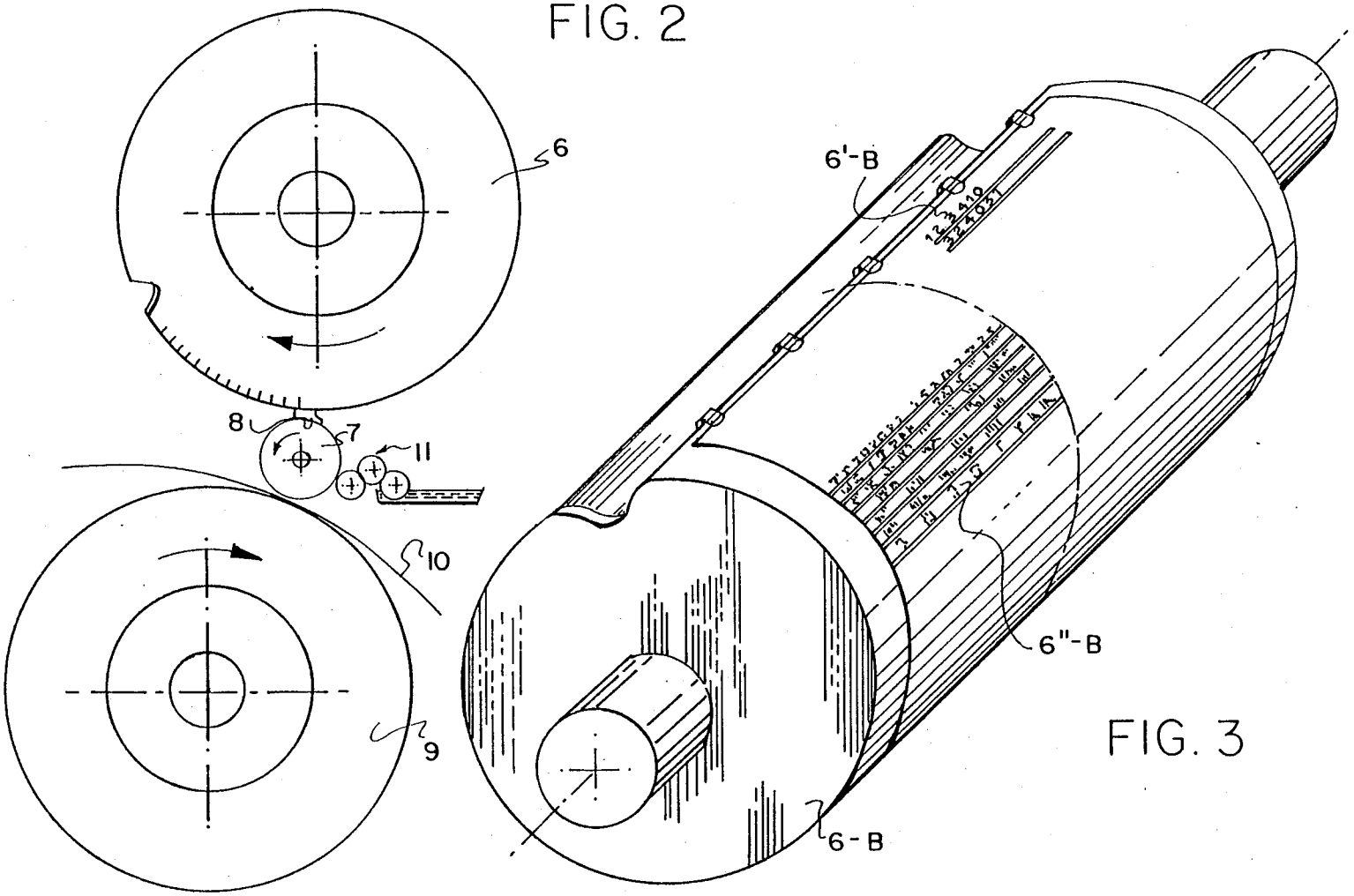
FIG. 2 is a schematic detail of the rollers and basic elements constituting the second non-repetitive particular printing group.
FIG. 3 is a perspective schematic view of the plate-bearing roller of the printing group illustrated in FIG. 2, and illustrates the manner in which said non-repetitive printing plate is divided for individual impression in each angular displacement of said roller.

The second printing body B consists in a fountain and inking roller sets b feeding and inking the matrix-plate bearing cylinder 6-B, the periphery of which in turn engages cylinder 7 carrying the rubber blanket 8 for transferring impressions 6'-B and 6''-B (FIGS. 3–5) to sheet 1, printing cylinder 9 acting to provide the necessary counterpressure against cylinder 7 and its blanket 8 through sheet 1 being impressed by 6'-B and 6''-B (FIGS. 3 and 5).

Previously, the masters or plates having a reporter-printing matrix are produced according to the printing pattern for each case and in the particular manner detailed hereinafter for the plate employed by the plate-bearing cylinder 6-B machine printing body B.

Said plates are introduced in the usual manner, preparing a lyophilous printing matrix having a resist of hydrophilous plate to be engaged by the corresponding humidifying and inking rollers, and anchoring said plates on the periphery of the bearer cylinders by means of conventional affixing means.

Turning now to the preparation of the master or matrix plate corresponding to the 6-B cylinder in printing body B, the useful length thereof is divided by the number of possible and prearranged variants for printing particular arabic numbers 6'-B and magnetic data 6''-B in accordance with the number of checks 10 forming part of each checkbook. For instance, if the latter is to comprise fifty checks 10, the useful length circumference of plate 6-B is divided in fifty equal and equi-distant sections. However, care must be taken to maintain the logical and progressive sequence corresponding to each checks (according to the example) in the amount of four per sheet, in order that the latter are numbered decreasingly in each checkbook. The object of this is to facilitate the cutting of the printed sheets and assembly of the checkbook in the logical and progressive numerical order of each check 10 (FIGS. 2 and 3).

The master or matrix plate thus divided is applied onto cylinder 6-B, which functions in an intermittent sequential manner with angular displacements step by step corresponding to the angular section of said plate wherein each particular impression division 6'-B and 6''-B is arranged (FIG. 3). The cylinder 6-B is of equal diameter to that of the counter-pressure cylinder 9, while cylinder 7 bearing the rubber blanket 8 has a diameter equal to ¼th the diameter of cylinders 6-B and 9. Consequently, with each full turn of cylinder 7, cylinder 6-B, inked by cylinder b advances one step which coincides positionally with rubber blanket 8 to which it transfers particular impression 6'-B and 6''-B. In turn, the impressions are impressed against sheet 1 at the exact prearranged position, while cylinder 7 continues its gyration which is completed upon a new encounter with the following differentiated division 6'-B and 6''-B of cylinder 6-B. Prior to said encounter, the rubber blanket 8 is submitted to the action of cleaning rollers 11 (FIG. 2) and printed sheets 10 exit through the outlet and piling tray 10' (FIGS. 1, 4 and 5).

By virtue of the continuity in the printing system and irrespectively of the differences in pressruns, the printing is adapted to be computerized.

It is clear that those skilled in the art will be able to introduce modifications in constructive and operating details of the printing machine of this invention, as well as in the operative stages constituting the procedure, without departing from the fundamental principles which are clearly substantiated in the following claims.

What is claimed is:

1. A device for printing a set of documents on a single sheet, each document having common repetitive impressions and common semi-repetitive impressions, each document in the set having its own differentiated impression, comprising: a first printing body including inking rollers, a fountain supplying ink to said inking rollers, a first printing matrix engageable with said inking rollers so as to receive ink from said inking rollers, and a rubber bearing cylinder for transferring ink from said first printing matrix to said single sheet, said first printing matrix carrying a pattern corresponding to the common semi-repetitive impressions for printing each document of the set of documents on said single sheet with common semi-repetitive impression; a second printing body including a second printing roller carrying a second printing matrix, a second inking roller for applying ink to said second printing matrix and a second transfer cylinder, said second printing matrix having a printing length which is divided into a number of printing portions at least equal to the number of differentiated impressions for all the documents in the set of documents on said single sheet, each printing portion carrying a pattern corresponding to a different one of the differentiated impressions for the documents in the set of documents, said second set printing body printing each document of the set of documents with its own different differentiated impression, conveyor means for transferring a sheet having sets of documents, between said first and second printing body so that each sheet is printed with the common semi-repetitive impressions and each document on said sheet is printed with one of the differentiated impressions, said conveying means including an endless plier chain conveyor extending from said first printing body to said second printing body so as to individually feed said single sheets to said second printing body; indexing means operatively connected to said second printing body for indexing said second printing matrix by an amount equal to the length of each printing portion of each document or sets of documents before each document on said single sheet is printed by said second printing body, said indexing means including means for rotating said second printing roller by an angular amount corresponding to the length of a printing portion, and a transfer blanket covering part of said second transfer cylinder for transferring ink from the patterns at one end of said printing portions onto a document; storage means for storing a stack of sheets preprinted with the common repetitive impression, adjacent the first printing body and for supplying the sheets, individually, to the first printing body; and, a tray, adjacent said second printing body for receiving single sheets having the set of documents thereon, from said second printing body, each sheet having been printed with said semi-repetitive impressions and with one of said differentiated impressions.

2. A device according to claim 1, further comprising: first automatic insertion station, adjacent said first printing body, for inserting printing matrix plates, automatically, into said first printing matrix, and, second automatic insertion station for automatically inserting printing matrix plates into said second printing matrix so that said first and said second printing matrix may be changed by changing the printing matrix plates.

3. A device for printing a set of documents on a single sheet, each document having common repetitive impressions and common semi-repetitive impressions, each document in the set having its own differentiated impression, comprising:

first printing means having a first printing matrix carrying a pattern corresponding to the common semi-repetitive impressions, said first printing means being for printing said single sheet and each document of the set of documents with the common semi-repetitive impressions;

second printing means having a second printing matrix with a useful printing length which is divided into a number of printing portions at least equal to the number of differentiated impressions for all the documents in the set of documents, each printing portion carrying a pattern corresponding to a different one of the differentiated impressions for the documents in the set of documents on said single sheet, said second printing means being for printing each document of the set of documents with its own differentiated impressions;

conveyor means for transferring sheets having sets of documents between said first and second printing means so that each document is printed with the common semi-repetitive impressions and with one of the differentiated impressions; and indexing means operatively connected to said second printing means for indexing said second printing matrix by an amount equal to the length of each printing portion before each document is printed by said second printing means;

wherein said first printing means comprises a first printing cylinder carrying said first printing matrix, a first inking cylinder engageable with said first printing matrix for applying ink to said first printing matrix and a first transfer cylinder for transferring ink form said first printing matrix to a document, said second printing means comprising a second printing cylinder carrying said second printing matrix, a second inking cylinder for applying ink to said second printing matrix and a second transfer cylinder, said indexing means comprising means for rotating said second printing cylinder by an angular amount corresponding to the length of a printing portion, and a transfer blanket covering part of said second transfer cylinder for transferring ink from the patterns at one of said printing portions onto a document, storage means for storing a stack of single sheets having documents preprinted with the common repetitive impressions adjacent the first printing means and for supplying the sheets having documents pre-printed thereon to the first printing means, said conveying means comprising an endless plier chain conveyor extending from said first printing means to said second printing means, and a tray adjacent said second printing means for receiving single sheets having the set of documents thereon, from said second printing means which have been printed with said semi-repetitive impressions and with one of said differentiated impressions.

4. A device according to claim 3, wherein each of said first and second matrices comprises a lyophilous printing matrix having a hydrophilous resist, each of said first and second printing means including its own set of rollers for humidifying respective first and second inking cylinder.

* * * * *